US006145696A

United States Patent [19]

Duncan

[11] Patent Number: 6,145,696

[45] Date of Patent: Nov. 14, 2000

[54] COOLER COVER

[75] Inventor: Michael Wayne Duncan, Lake City, Minn.

[73] Assignee: Even Par Enterprises, Inc., Lake City, Minn.

[21] Appl. No.: 09/241,187

[22] Filed: Feb. 1, 1999

[51] Int. Cl.[7] ..... B65D 65/02

[52] U.S. Cl. ..... 220/739; 220/915.2; 150/154

[58] Field of Search ..... 220/915.2, 903, 220/737, 739, 740, 23.83, 23.86, 23.87; 150/165, 901, 154; 206/457

[56] References Cited

U.S. PATENT DOCUMENTS

| | | | |
|---|---|---|---|
| 4,932,524 | 6/1990 | Hodson | 206/320 |
| 5,048,734 | 9/1991 | Long | 224/148.3 |
| 5,104,833 | 4/1992 | Matsumoto et al. | 501/104 |
| 5,251,460 | 10/1993 | DeMarco et al. | 62/371 |
| 5,403,095 | 4/1995 | Melk | 383/110 |
| 5,609,265 | 3/1997 | Haberkorn et al. | 220/421 |
| 5,782,360 | 7/1998 | Markson | 206/600 |

*Primary Examiner*—Stephen Castellano
*Attorney, Agent, or Firm*—Joseph R. Kelly; Westman, Champlin & Kelly, P.A.

[57] ABSTRACT

The present invention is a cover having a camouflaged pattern disposed thereon, and configured to releasably receive a cooler or other similar container.

6 Claims, 1 Drawing Sheet

COOLER COVER

BACKGROUND OF THE INVENTION

The present invention relates to a covering device. More specifically, the present invention relates to a cover or jacket for a cooler, or other similar container item.

In some activities, such as wildlife observation, wildlife photography, and hunting, participants are commonly heavily camouflaged. This can include wearing camouflage clothing, and can even include camouflage paint which is employed on exposed skin surfaces, such as the face and hands. It may also be desirable to take a cooler into such environments, to maintain soft drinks and food items in a cooled environment.

In the past, this has presented a significant problem. For instance, such coolers are commonly made of relatively bright colors. This requires the users of the cooler to hide the cooler behind brush, trees, etc., in order to reduce the likelihood that wildlife will be frightened away when spotting the cooler.

SUMMARY OF THE INVENTION

The present invention is a cover having a camouflaged pattern disposed thereon, and configured to releasably receive a cooler or other similar containment structure.

DETAILED DESCRIPTION OF THE PREFERRED EMBODIMENTS

Figure 1:
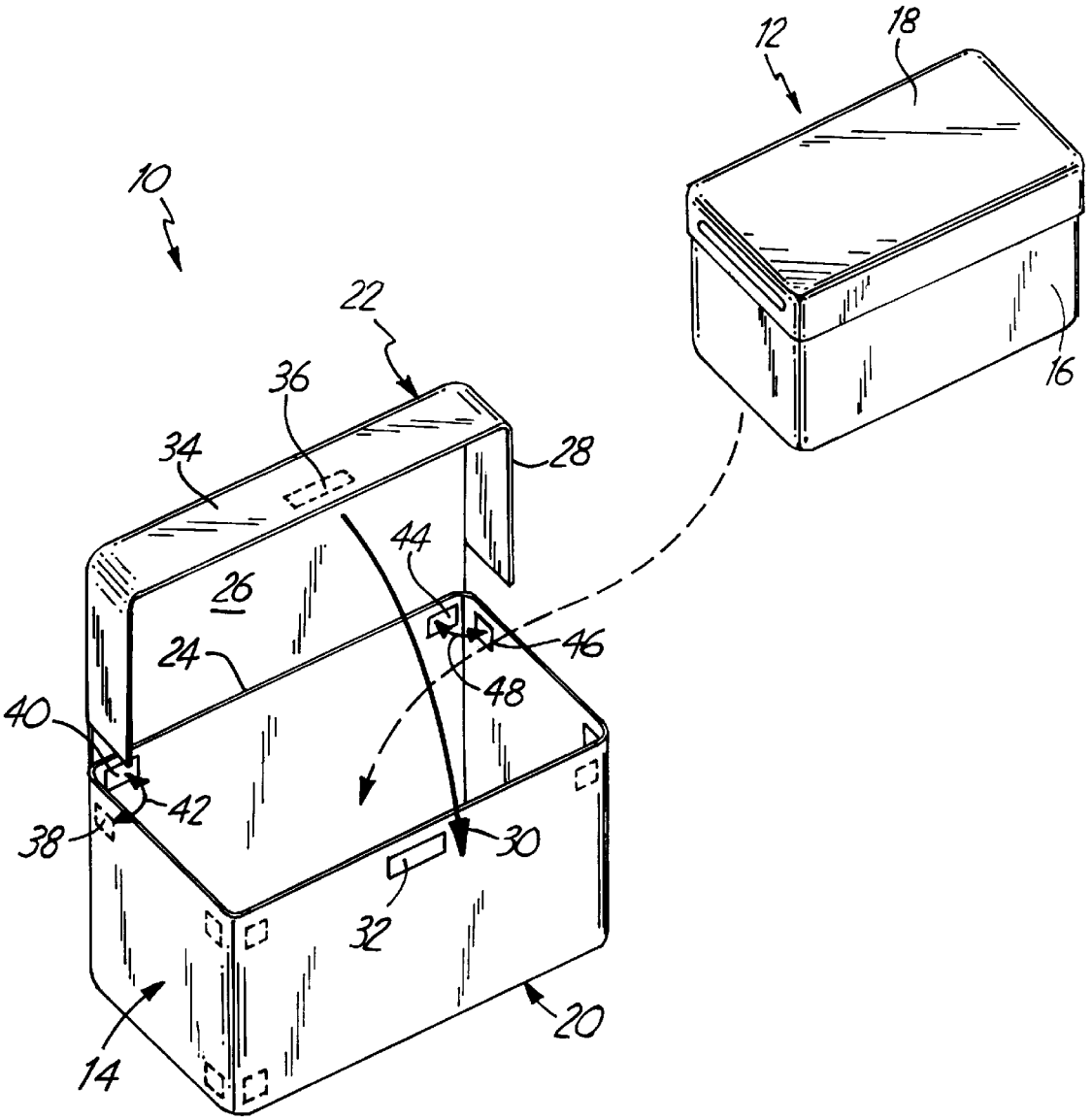
FIG. 1 is an exploded perspective view of a cover in accordance with one embodiment of the present invention.

FIG. 1 is an exploded perspective view of a container camouflage system 10 in accordance with one aspect of the present invention. System 10 includes a container (such as a cooler) 12 and camouflaged covering device 14. Cooler 12 is preferably any conventional cooler having a body portion 16 and an openable top portion 18.

Covering device 14 is preferably formed of a lightweight material, such as canvas or fabric, which has a camouflage pattern disposed on all surfaces thereof. The camouflage pattern can be integrally formed into the lightweight material forming the covering device, or it can be printed or otherwise disposed thereon.

Covering device 14 includes a cooler receiving portion 20 and a covering flap 22. Cooler receiving portion 20 preferably includes four side panels and a bottom panel which define a cavity having an upper opening sized to receive a desired size cooler 12. Covering flap 22 is preferably stitched or otherwise secured to cooler receiving portion 20 along a seam or hinge region 24. Covering flap 22 preferably includes a panel 26 which forms the top of covering device 14, and also includes a side flap 28 which has an inner periphery sized just larger than the outer periphery of the side panels of cooler receiving portion 20. Side flap 28 thus preferably fits thereover when covering flap 22 is rotated into the covering position as illustrated by arrow 30.

Cooler receiving portion 20 also preferably includes a fastener member 32 which is adhered thereto, stitched thereto or otherwise fixedly attached thereto. Covering flap 22 has a front portion 34 which also includes a mating fastening member 36 disclosed on the inside surface thereof. Therefore, when covering flap 22 is rotated to the covering or closed position, fastening member 36 overlies fastening member 32. In one embodiment, fastening members 32 and 36 are hook and loop fasteners for securing covering flap 22 in the covering or closed position with respect to cooler receiving portion 20. However, any other suitable fasteners for fastening covering flap 22 to cooler receiving portion 20 can be used as well, such as snaps, buttons, zippers, etc.

Also, in accordance with one preferred embodiment of the present invention, cooler receiving portion 20 preferably has a pair of fastening members 38 and 40 disposed on adjacent wall panels near an upper end thereof (e.g., closely proximate the opening defined by the panels). In one preferred embodiment, fastening members 38 and 40 are similar to fastening members 23 and 36 (such as hook and loop fasteners, snaps, buttons, etc.) which can be releasably secured to one another. In this way, if cooler receiving portion 20 is larger than cooler 12, fastening members 38 and 40 can be releasably fastened to one another to cinch or narrow the opening defined by the upper end of the wall panels of cooler receiving portion 20. Fastening members 38 and 40 are preferably arranged to be fastened to one another by simply pinching the outside of the panels upon which they are disposed, as generally indicated by arrow 42.

In accordance with another preferred embodiment thereof, cooler receiving portion 20 includes one or more additional sets of fastening members 44 and 46 on another corner of cooler receiving portion 20. Again, as with fastening members 38 and 40, fastening members 44 and 46 are arranged on the side panels of the cooler receiving portion 20, so that they can be fastened to one another by simply pinching them together as generally illustrated by arrow 48. Of course, additional fastening members can be provided on the other corners as well, or vertically disposed along the side panels and those fasteners are indicated in phantom in FIG. 1.

It should also be noted that the size and placement of fastening members 38 and 40 will dictate how much the cooler receiving cavity defined by cooler receiving portion 20 is narrowed or cinched. For example, if fastening members 38 and 40 are located further away from one another along the upper surface of their corresponding panels, pinching them together will cause a greater reduction in the opening in cooler receiving portion 20, than if they are located closely adjacent one another on their corresponding panels. It should also be noted that the fastening members on the various corners of cooler receiving portion 20 can be placed different distances apart to accomplish a different degree of restriction or cinching of the opening.

Although the present invention has been described with reference to preferred embodiments, workers skilled in the art will recognize that changes may be made in form and detail without departing from the spirit and scope of the invention.

What is claimed is:

1. A cover for a container, the cover comprising:

a container receiving portion having an opening sized to removably receive the container;

a cover flap movably coupled to the container receiving portion and being sized to cover the opening, the cover flap and container receiving portion being made of pliable material;

a cover fastener disposed on the container receiving portion and the cover flaps to releasably secure the container receiving portion and the cover flaps to one another; and wherein the container receiving portion includes a plurality of connected side panels having a first side panel fastener disposed on one of the plurality of connected side panels and a second side panel fastener disposed on two of the plurality of connected side panels, said first and second fasteners being configured to restrict the opening to a smaller size when fastened.

2. The cover of claim 1 wherein the second side panel fastener is offset from the first side panel fastener in a direction generally away from the cover flap.

3. The cover of claim 1 wherein the cover flap includes:

a cover panel sized to generally cover the opening in the container receiving portion; and a depending strip, depending from an outer periphery of the cover panel and sized to extend about a portion of the container receiving portion.

4. The cover of claim 3 wherein the cover fastener includes a first member connected to the container receiving portion and a second member, releasably securable to the first member, connected to the depending strip.

5. In combination, a cooler and a flexible cover for covering the cooler, the cover comprising:

a cooler receiving portion including a plurality of connected side panels defining a generally rectangular shaped opening sized to removably receive the cooler;

a cover flap movably coupled to the cooler receiving portion and being sized to substantially cover the opening in the cooler receiving portion; and wherein the plurality of connected side panels has a first side panel fastener disposed on one of the plurality of connected side panels and a second side panel fastener disposed on two of the plurality of connected side panels, said first and second fasteners being configured to restrict the opening to a smaller size when fastened.

6. A cover for a container, the cover comprising:

a container receiving portion having a plurality of connected side panels defining an opening sized to removably receive the container a cover flap movably coupled to the container receiving portion and being sized to receive ends of the side panels defining the opening;

wherein the container receiving portion and the cover flap are formed of pliable material having a camouflaged pattern disposed on surfaces thereof;

a first side panel fastener disposed on one of the plurality of side panels and configured to restrict the opening to a smaller size when fastened; and a second side panel fastener disposed on two of the plurality of connected side panels and being configured to restrict the opening to a smaller size when fastened.

* * * * *